US006478603B1

(12) United States Patent
Wu

(10) Patent No.: US 6,478,603 B1
(45) Date of Patent: Nov. 12, 2002

(54) ELECTRICAL CONNECTOR WITH MECHANICALLY REINFORCED BLIND MATING GUIDES

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/036,119

(22) Filed: Dec. 24, 2001

(51) Int. Cl.[7] ..... H01R 13/64
(52) U.S. Cl. ..... 439/378; 439/79
(58) Field of Search ..... 439/378, 79, 108, 439/101

(56) References Cited

U.S. PATENT DOCUMENTS

| | | | | |
|---|---|---|---|---|
| 5,356,300 A | * | 10/1994 | Costello et al. | 439/378 |
| 5,547,385 A | * | 8/1996 | Spangler | 439/108 |
| 5,863,222 A | * | 1/1999 | Kinsey, Jr. et al. | 439/79 |
| 6,343,951 B1 | * | 2/2002 | Ono et al. | 439/108 |
| 6,354,875 B1 | * | 3/2002 | Wu | 439/108 |

* cited by examiner

*Primary Examiner*—Gary Paumen
(74) *Attorney, Agent, or Firm*—Wei Te Chung

(57) ABSTRACT

An electrical connector includes an elongate housing extending in a horizontal direction and contacts retained therein. The housing has a front mating face for engaging with a mating connector and an opposite rear face. The contacts extend beyond the rear face and form soldering tails extending in a vertical direction toward a circuit board. Two blocks are formed on opposite lengthwise ends and extend in a frontward direction. Each block defines a guide channel for receiving a corresponding guide post of the mating connector. A ground terminal is fixed in the channel and electrically connected to the circuit board for engaging and grounding a corresponding terminal formed on the guide post of the mating connector. Two partition walls extend from the lengthwise ends of the housing in a rearward direction, delimiting a space accommodating the soldering tails of the contacts. Each end of the housing forms a rib extending between a rear end of each block and the corresponding partition wall for mechanically reinforcing the block against an insertion force induced thereon by the mating engagement of the connector with the mating connector. The reinforcement effectively reduces the risk of breakage of the connection between the block and the housing itself.

1 Claim, 2 Drawing Sheets

ELECTRICAL CONNECTOR WITH MECHANICALLY REINFORCED BLIND MATING GUIDES

BACKGROUND OF THE INVENTION

1. Field of the Invention

The present invention generally relates to the field of electrical connectors, and more particular to an electrical connector with alignment guides for blind-mating with a mating connector.

2. The Related Arts

Electrical connector assemblies for mating each other to connect an apparatus, such as a disk drive of a computer, to another apparatus, such as a docking station, are known in the art, such as SCA-2 based connectors. The assembly comprises a socket connector that is mounted in a recessed portion of the docking station and a plug connector to be inserted into the recessed portion to engage the socket connector. Such an insertion process is in general not visually observable and is sometimes referred to as "blind mating". Thus, guide posts are provided on the plug connector, while complementary guide channels are formed on the socket connector for receiving the guide posts. The engagement of the guide posts and guide channels helps correctly aligning the connectors with each other.

When the connectors mate with each other, they are electrically connected. To ensure protection of the related devices from damage caused by electrostatic discharge, grounding means must be provided to grounding the devices before signal contacts of the connectors engage each other. Traditionally, the plug connector is provided with grounding terminals extending along the guide posts whereby when the guide posts is received into the guide channels, a grounding path is established between the connectors. Damage caused by electrostatic discharge can thus be effectively eliminated.

The socket connector that is arranged in the recessed portion of the docking station is mounted to a circuit board inside the docking station. The socket connector can be mounted to the circuit board in a vertical mount fashion where a rear face of the socket connector is positioned on and thus supported by the circuit board or in a right angle mount fashion where the rear face of the connector is substantially perpendicular to the circuit board. When the plug connector is fit into the socket connector, an insertion force is induced on the socket connector in a direction substantially toward and normal to the rear face. In the vertical mount fashion, the insertion force can be directly taken by the circuit board, while in the right angle mount fashion, such a force is transmitted to the circuit board by the contacts of the connector that are soldered to the circuit board.

Conventionally, the guide channels are formed on opposite ends of the connector and supported by a slim connection between the connector and the guide channel. Thus, the guide channels are in general not firmly supported by the contacts. This induces a structural weakness in the socket connector. Such a weakness may lead to breakage of the guide channels from the connector housing when an improper mating operation causes undue forces on the guide channels.

Obviously, a reinforcement of the guide channels and/or guide posts of the connectors of this kind would be of great help in reducing expenses of repairing and maintenance of the connectors.

SUMMARY OF THE INVENTION

Accordingly, an object of the present invention is to provide electrical connector of the kind discussed previously that possesses mechanically reinforced guide channels and/or guide posts for alleviating breakage caused by inherent structure weakness.

Another object of the present invention is to provide electrical connector of the kind discussed previously having reinforced structure for reducing risk of undesired breakage thereof.

To achieve the above objects, in accordance with the present invention, an electrical connector comprising an elongate housing extending in a horizontal direction and contacts retained therein. The housing has a front mating face for engaging with a mating connector and an opposite rear face. The contacts extend beyond the rear face and form soldering tails extending in a vertical direction toward a circuit board. Two blocks are formed on opposite lengthwise ends and extend in a frontward direction. Each block defines a guide channel for receiving a corresponding guide post of the mating connector. A ground terminal is fixed in the channel and electrically connected to the circuit board for engaging and grounding a corresponding terminal formed on the guide post of the mating connector. Two partition walls extend from the lengthwise ends of the housing in a rearward direction, delimiting a space accommodating the soldering tails of the contacts. Each end of the housing forms a rib extending between a rear end of each block and the corresponding partition wall for mechanically reinforcing the block against an insertion force induced thereon by the mating engagement of the connector with the mating connector. The reinforcement effectively reduces the risk of breakage of the connection between the block and the housing itself.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
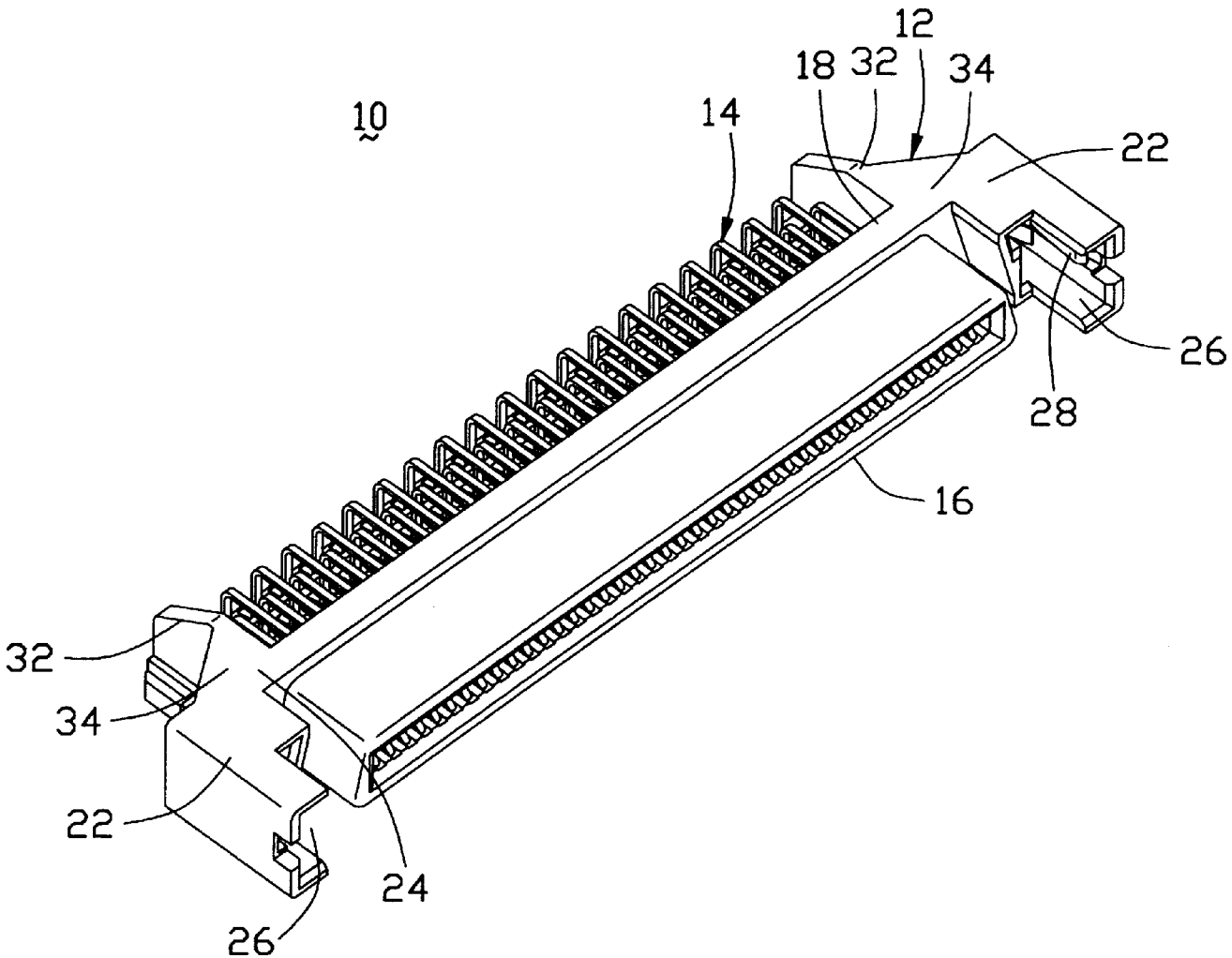
FIG. 1 is a perspective view of an electrical connector in accordance with the present invention observed from front side thereof.
Figure 2:
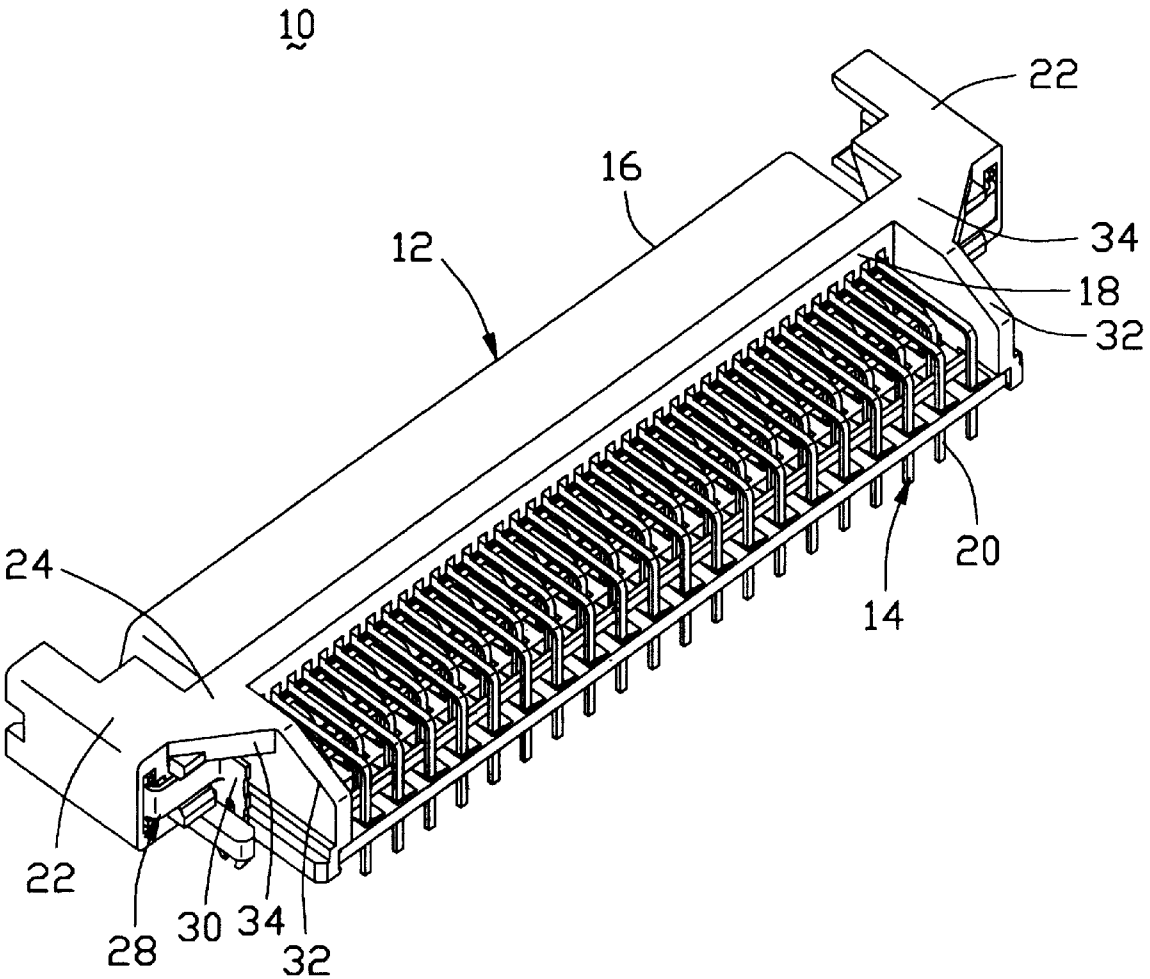
FIG. 2 is a perspective view of the electrical connector observed from rear side thereof.

With reference to both FIGS. 1 and 2, an electrical connector constructed in accordance with the present invention, generally designated with reference numeral 10, comprises an elongate housing 12 made of insulation materials and conductive contacts 14 retained in the housing 12. The housing 12 is to be positioned on a circuit board (not shown) with the contacts 14 electrically connected to the circuit board.

The housing 12 has a mating port with a front, mating surface 16 for engaging with a mating connector (not shown) with the contacts 14 electrically engaging corresponding contacts of the mating connector. The housing 12 also has a rear surface 18 opposite to the mating surface. The contacts 14 extend beyond the rear surface 18 of the housing 12 and each has a soldering tail 20 perpendicularly extending from the contact 18 toward the circuit board. The soldering tails 20 are soldered to the circuit board to form electrical connection between each contact 14 and the circuit board.

The housing 12 has opposite lengthwise ends each forming a block 22. The block 22 is connected to the housing 12 by a connection 24 and extends in a frontward direction beyond the mating surface 16 for contacting the mating connector before the contacts 14 engage the corresponding contacts of the mating connector. Each block 22 forms a guide channel 26 with a grounding terminal 28 fixed therein. A tail 30 of the grounding terminal 28 extends to and is soldered to the circuit board.

A partition wall 32 extends in a rearward direction from each lengthwise end of the housing 12 to delimit a space therebetween for accommodating the soldering tails 20 of the contacts 14 therein. A spacer 33 is attached to and extends between the partition walls 32 for spacing the tails 20 from each other.

A rib 34 is formed between a rear end of each block 22 and the corresponding partition wall 32 for structural reinforcement of the block 22. The reinforcing rib 34 helps resisting against or counteracting an insertion force acting upon the block 22 when the guide channel 26 receives the corresponding guide post of the mating connector in a non-precisely aligned condition. Thus the risk of breaking the connection 24 between the block 22 and the housing 12 itself is reduced.

Although the present invention has been described with reference to the preferred embodiment thereof, it is apparent to those skilled in the art that a variety of modifications and changes may be made without departing from the scope of the present invention which is intended to be defined by the appended claims. For example, more than one rib can be formed between each block and the partition wall. The rib may also be formed between the block 22 and the housing 12 itself.

What is claimed is:

1. An electrical connector comprising:

an insulative housing having front and rear faces and opposite ends, a block being connected to each end of the housing and extending frontward beyond the front face, guide means being formed on the block and adapted to engage counterpart guide means formed on a mating connector to guide mating engagement between the electrical connector and the mating connector;

conductive contacts being retained in the housing and partially extending beyond the rear face, each contact having a soldering tail perpendicularly extending therefrom;

wherein a reinforcement is formed between each block and the housing to at least partially counteract an insertion force caused by the mating engagement of the mating connector with the electrical connector;

wherein opposite partition walls rearwardly, extend from the ends of the housing to delimit a space therebetween for accommodating the tails of the contacts and wherein the reinforcement comprises a triangular rib extending between a rear end of each block and the corresponding partition wall;

wherein a spacer is attached to and extending between the partition walls for spacing the tails from each other;

wherein the guiding means of each block comprises a channel defined in the block for receiving a guiding post of the mating connector;

wherein a grounding terminal is arranged in the channel for electrically engaging a counterpart grounding terminal of the mating connector, a vertical tail of the grounding terminal being located under the rib.

* * * * *